US005078569A

United States Patent [19]

Cook

[11] Patent Number: 5,078,569

[45] Date of Patent: Jan. 7, 1992

[54] QUICK ATTACHING MECHANISM FOR A FRONT-END LOADER

[75] Inventor: Kurt I. Cook, Downers Grove, Ill.

[73] Assignee: J. I. Case Company, Racine, Wis.

[21] Appl. No.: 516,169

[22] Filed: Apr. 30, 1990

[51] Int. Cl.[5] ..... E02F 3/80

[52] U.S. Cl. ..... 414/723; 414/685

[58] Field of Search ..... 414/680, 685, 722, 723, 414/724

[56] References Cited

U.S. PATENT DOCUMENTS

| | | | |
|---|---|---|---|
| 2,963,183 | 12/1960 | Przybylski | 414/723 |
| 3,204,793 | 9/1965 | Lane | 414/723 X |
| 3,220,487 | 11/1965 | Pilch | 414/686 X |
| 3,231,117 | 1/1966 | Melroe et al. | 414/715 |
| 3,269,570 | 8/1966 | Wallberg | 414/723 |
| 3,672,521 | 6/1972 | Bauer et al. | 414/723 |
| 3,732,996 | 5/1973 | Bauer | 414/686 X |
| 3,760,883 | 9/1973 | Birk | 414/723 X |
| 3,794,195 | 2/1974 | Clevenger et al. | 414/723 |
| 3,818,551 | 6/1974 | Coughran, Jr. | 414/723 X |
| 3,845,871 | 11/1974 | DeLillo | 414/723 |
| 3,964,622 | 6/1976 | Blair et al. | 414/723 |
| 3,984,016 | 10/1976 | Kuhn | 414/686 |
| 3,985,249 | 10/1976 | Aker et al. | 414/723 |
| 4,030,624 | 6/1977 | Matthews | 414/723 |
| 4,106,645 | 8/1978 | Janish | 414/723 |
| 4,119,225 | 10/1978 | Macht et al. | 414/723 |
| 4,136,792 | 1/1979 | Wilson | 414/723 |
| 4,243,356 | 1/1981 | Takojima | 414/723 |
| 4,545,720 | 10/1985 | Cochran et al. | 414/723 |
| 4,586,867 | 5/1986 | Stafford | 414/723 |
| 4,812,103 | 3/1989 | Cochran et al. | 414/723 |
| 4,850,790 | 7/1989 | Johnson et al. | 414/723 |

FOREIGN PATENT DOCUMENTS

| | | | |
|---|---|---|---|
| 0031659 | 3/1980 | Japan | 414/723 |
| 0065639 | 5/1980 | Japan | 414/723 |
| Nr. 91351 | 3/1958 | Norway . | |
| 975029 | 11/1964 | United Kingdom . | |

*Primary Examiner*—Robert J. Spar
*Assistant Examiner*—James T. Eller, Jr.
*Attorney, Agent, or Firm*—Dressler, Goldsmith, Shore, Sutker & Milnamow

[57] ABSTRACT

A quick attaching mechanism adapted to automatically fasten an implement to a boom assembly of a front-end loader. The quick attaching mechanism is designed to accommodate a broad range of lateral spacing between lift arms of the boom assembly and mounting structures on the implement to be attached thereto. The quick attaching mechanism includes a pair of male coupling structures carried at a forward end of the boom assembly and which are releasably fastened to female coupling structures on the implement. Each male coupling structure includes a fastening pin which is automatically operated to releasably fasten the implement to the boom assembly.

16 Claims, 4 Drawing Sheets 16
24
20
10
26
28
22
29
18
12
14
45
14

56
41
40
50
34
32
38
48
104
92
36
70
45
42
46
30
18

80
82
70
18
50
44
56
76
54
70
98
42
74
38
30
36
41
80
82
78
32
96
46
66
68
92
45
29
22
28
24
20

41
30
29
82
80
50
56
76
18
64
54
68
70
42
74
78
24
66
60

50

80
46
82
76
62
64
32
38
52
54
70
96
90
84
100
72
92
98
42
86
78
88
74
58
60
56

QUICK ATTACHING MECHANISM FOR A FRONT-END LOADER

FIELD OF THE INVENTION

The present invention generally relates to material handling apparatus such as front-end loaders and, more particularly, to a quick attaching mechanism designed to automatically attach an implement to a boom assembly of the front-end loader while accommodating a broad range of lateral spacings between the boom assembly and mounting structure provided on the implement to be attached thereto.

BACKGROUND OF THE INVENTION

A front-end loader is an extremely versatile apparatus which is useful in agricultural and construction industries. A typical front-end loader has a self-propelled frame mounted on wheels or the like with a boom assembly including an implement lifting mechanism including a pair of laterally spaced lift arms and an implement tilting mechanism. An implement is connected to a forward end of the boom assembly.

The versatility of the apparatus is enhanced if a variety of different implements may be interchangeably connected to the boom assembly. As an example, a dirt bucket may be connected to the boom assembly for one operation, while a snowplow, manure fork, forklift, or a myriad of other implements may be connected to the boom assembly to perform other operations. As will be appreciated, considerable time and effort can be realized by an efficient mechanism allowing for quick removal of one implement and attachment of another to the boom assembly.

Since the ease and rapidity of connecting or fastening an implement to the boom assembly greatly affects the utility and economy of the front-end loader, there have been a number of different proposals in the prior art to effect such ends. The problem of providing such a quick attaching mechanism is accentuated by the desire that such mechanisms operate automatically in connecting the implement to the boom assembly and by the working environment in which the front-end loader finds utility. Changing design characteristics of the front-end loader further complicate the ability to provide an automatically operated quick attaching mechanism which may be universally used to releasably attach different implements to the front end of a boom assembly.

One form of a known quick attaching mechanism includes a female coupling structure which is welded integrally to the implement and a male coupling structure. The male coupling structure is attached to the end of the boom assembly and is adapted to be selectively coupled and uncoupled to the female coupling structure. When the male coupling structure is fastened to the female coupling structure, the implement may be selectively lifted and lowered with the implement lifting mechanism and may be selectively tilted by the implement tilting mechanism. A relatively complicated hydraulic or manually activated wedge mechanism releasably fastens the male coupling structure to the female coupling structure.

Notably, the male coupling structure is attached to the forward end of the boom assembly forward of the wheels on the loader. As the front-end loader is operated, mud, dirt, sand, rocks and other abrasive materials found in the working environment are thrown by the wheels toward the implement and the quick attaching mechanism. Wearing surfaces on the wedge mechanism are exposed to the abrasive materials and it has been observed that such materials accumulate sufficiently to render the wedge mechanism inoperative. The ease, convenience and rapidity of attaching an implement to the boom assembly is therefore offset by the repair and maintenance times required to maintain the wedging mechanism in operative order.

Rather than wedge mechanisms, other quick attaching mechanisms use pins for attaching the male coupling structure to the female coupling structure. With today's increasing power demands, the configuration of the front-end loader changes to accommodate larger engine sizes. When the configuration of the front-end loader changes, however, the lateral spacing between the loader lift arms of the lift mechanism is also affected. With some front-end loaders, the lateral spacing between the lift arms can range between about 42 inches and about 55 inches.

The female coupling structure of known quick attaching mechanisms which use pins typically includes mounting brackets or flanges which extend rearwardly from a rear surface of the implement to be attached to the boom assembly. The mounting brackets of the female coupling structures conventionally define apertures which slidably receive the pins carried by the male coupling structures. Most pin-type quick attaching mechanisms generally align the mounting flanges on the implement with the loader lift arms. When the lateral spacing between the loader lift arms and the mounting flanges secured to the implement are not compatible, however, the pins used to attach the male and female coupling structures are rendered inoperative and the versatility of the quick attaching mechanism is lost.

A similar implement having compatible spacing between the mounting flanges of the female structure and the particular lateral spacing between the lift arms of the boom assembly will allow the implement to be connected to the loader. Such costly investments in similar implements may be avoided by realigning the mounting flanges on the implement to be compatible with the lateral spacing between the lift arms of the boom assembly. Such modifications are labor-intensive, costly, and, unless performed accurately, will not always achieve the desired results.

SUMMARY OF THE INVENTION

In view of the above, and in accordance with the present invention, there is provided a quick attaching mechanism that automatically fastens an implement to a boom assembly of a front-end loader and is designed to accommodate a broad range of lateral spacings between the lift arms of the boom assembly and mounting structure on the implement to be attached thereto. The ability of the present invention to automatically fasten an implement to a boom assembly facilitates ease of operation by allowing the operator to remain seated in a control of the loader during attachment of the implement.

The front-end loader to which the implement is to be releasably fastened is provided with a loader arm or boom assembly with an implement lifting mechanism including a pair of laterally spaced lift arms and an implement tilting mechanism. In a conventional manner, the implement is provided with a pair of female coupling structures integrally connected thereto. A horizontal mounting member extends above the female coupling structures and defines a downwardly opening channel on a rear surface of the implement. Preferably, each female coupling structure is an apertured mounting flange rigidly and backwardly extending from the rear surface of the implement. In the illustrated embodiment, the mounting flanges are spaced apart a predetermined distance which is less than a distance separating the lift arms of the boom assembly.

The quick attaching mechanism of the present invention includes a pair of laterally spaced male coupling structures which are joined by an elongated member. The male coupling structures are adapted to be operatively connected to the lift arms and the tilting mechanism of the boom assembly. Each male coupling structure defines an automatically operated attaching assembly which is adapted to be releasably fastened to a female coupling structure in a manner automatically fastening the implement to the boom assembly.

The elongated member that joins the coupling structures is adapted to be rotationally seated in the channel on the mounting member provided on the implement. In the illustrated embodiment, the automatically operated male coupling structures depend from and are connected to the elongated member in laterally spaced relation by a dimension greater than the maximum dimension separating the laterally spaced mounting flanges on the implement.

Each male coupling structure includes an automatically operated fastening pin. The fastening pin includes an elongated leg portion which is yieldably urged toward and movable into a fastening relation with a female coupling structure to releasably fasten the implement to the boom assembly. The fastening pin of at least one of the automatically operated assemblies is interchangeable with a like fastening pin having a different leg portion. Accordingly, by interchanging fastening pins, different spacings between the laterally spaced lift arms of the boom assembly and the laterally spaced mounting flanges of the female coupling structures on the implement will be accommodated while maintaining automatic operation of the quick release mechanism.

In a preferred form of the invention, each male coupling structure further includes inner and outer upright members. The inner and outer upright members are preferably secured to and depend from the horizontally elongated member which joins the male coupling structures in laterally spaced relation to each other. A remote end of a respective lift arm and a remote end of a respective implement tilting mechanism is articulately connected between the upright members. The inner and outer upright members furthermore define laterally aligned apertures which allow the elongated leg portion of the fastening pin to pass and move linearly therethrough.

In the illustrated embodiment, the automatically operated fastening pin is configured with a J-shape. A long leg of the J-shape fastening pin passes through the aligned apertures in the upright members of each automatically operated male coupling structure. A second leg portion on the J-shape fastening pin passes through another aperture defined by the outer upright member and passes across and above a portion of the implement tilting mechanism. A segment of the second leg portion of the fastening pin interacts with the implement tilting mechanism to initiate a fastening action between each automatically operated male coupling structure and the female coupling structure on the implement when the implement is tilted by the implement tilting mechanism.

To facilitate automatic operation, a spring mechanism is entrapped between the upright members of each male coupling structure for yieldably urging and automatically moving the fastening pin into a fastening relation with the adjacent mounting flange of the female coupling structure. In the preferred embodiment, one end of the spring acts against the fastening pin while a second end of the spring acts against the male coupling structure. To inhibit contaminants from interfering with its operation, the spring mechanism may be covered substantially along its entire length.

The implement can be readily disengaged from the boom assembly by pulling outwardly on each fastening pin, thus releasing the fastening pins from their connection to the mounting flanges of the female coupling structures. In the illustrated embodiment, and after pulling outwardly thereon, the fastening pin of each male coupling structure can be releasably maintained in a disengaged position simply by rotating the pin about the longitudinal axis of the elongated leg portion of the pin. In the preferred embodiment, the second leg portion of the fastening pin is preferably provided with a detent which is releasably held under spring tension by the outer upright member of the male coupling structure whereby placing it into a disengaged position where it cannot move. In its disengaged position, a segment of the second leg portion is disposed for actuation by the implement lifting mechanism, thereby releasing the fastening pin and automatically fastening the implement to the boom assembly.

The automatically operated male coupling structures are further interconnected by a lateral stabilizer which adds rigidity to the quick attaching mechanism. The lateral stabilizer includes a pair of laterally spaced apertured members which extend toward a rear surface on the implement. The apertured members are arranged inwardly of the female coupling structures on the implement and are adapted to receive a free end of the automatically operated fastening pins of the male coupling structures passing theretowards from opposite sides of the female coupling structures. By such construction, each fastening pin is arranged in double shear after it passes through a mounting flange of the female coupling structures on the implement.

An advantage of the present invention is that it accommodates a broad range of lateral spacings between the lift arms of the boom assembly and the mounting structures on the implement while facilitating automatic fastening of the implement to the boom assembly. With the present invention, the female coupling structures and the male coupling structures remain operational to connect the implement to the boom assembly even though the lateral spacing between the lift arms of the boom assembly may alter or vary. Moreover, the automatic operation of each male coupling structure offers a simple and reliable means of attaching the boom assembly to the implement without requiring operator intervention during the fastening procedure.

Numerous other features and advantages of the present invention will become readily apparent from the following detailed description, appended drawings, and accompanying claims.

DETAILED DESCRIPTION OF THE PRESENT INVENTION

Figure 1:
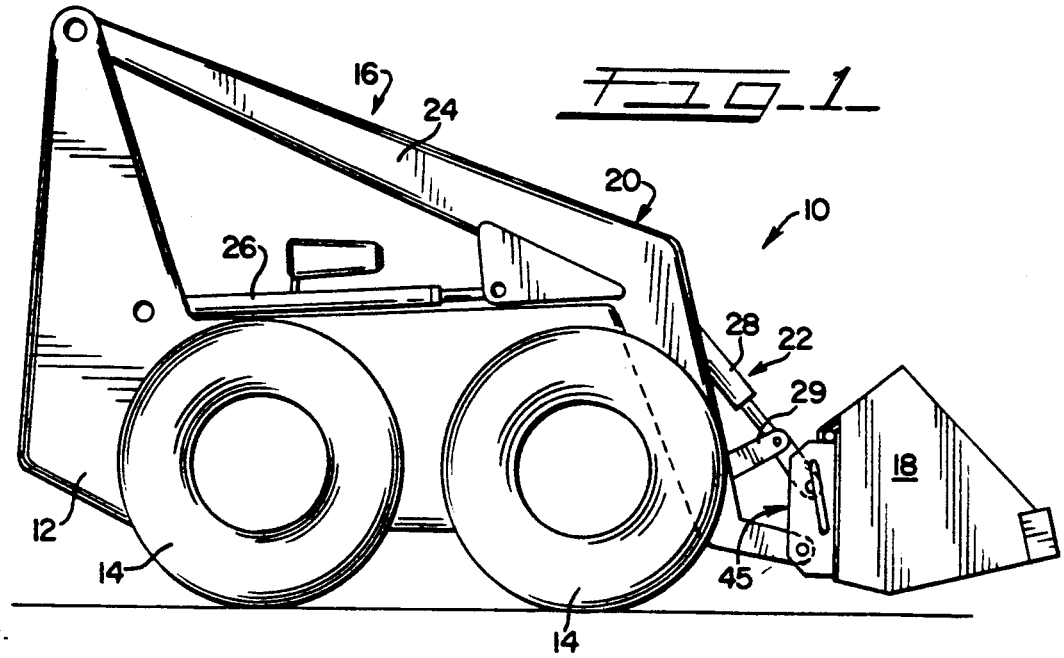
FIG. 1 is a side elevational view of a front-end loader having an implement connected to a boom assembly with a quick attaching mechanism incorporating principles of the present invention.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Referring now to the drawings, wherein like reference numerals indicate like parts throughout the several views, there is shown a self-propelled material handling apparatus such as a front-end loader 10. The front-end loader includes a frame 12 supported on wheels 14 and a boom assembly 16 which, at its forward end, is connected to a bucket 18 which is a representative example of various implements that are useful with such a loader. Similar loaders have been made and sold for many years by J. I. Case Company of Racine, Wisconsin. Except as described hereinbelow, the implement or bucket 18 is similar to buckets that have been sold for many years by J. I. Case Company.

The boom assembly 16 comprises an implement lifting mechanism 20 and an implement tilting mechanism 22. The implement lifting mechanism 20 provides means for raising and lowering the implement 18 relative to the frame 12. The implement tilting mechanism 22 provides means for tilting the implement about a generally horizontal axis.

In the illustrated embodiment, the lifting mechanism includes a pair of laterally spaced lift arms 24 (only one of which is illustrated in FIG. 1). A rearward end of each lift arm 24 is pivotally secured to the frame 12 and a remote forward end of each arm 24 is connected to the implement 18 in a manner defining the generally horizontal axis about which the implement is tilted. Each lift arm 24 is connected to a linearly distendable driver 26 for imparting vertical swinging movements to the lift arms 24. The drivers 26 are preferably in the form of hydraulically driven pistons.

As illustrated, the implement tilting mechanism 22 includes a pair of hydraulically operated load tilting pistons 28 (only one of which is illustrated in FIG. 1). A remote forward end of each load tilting piston 28 is connected to the implement by a suitable linkage mechanism 29.

Figure 2:
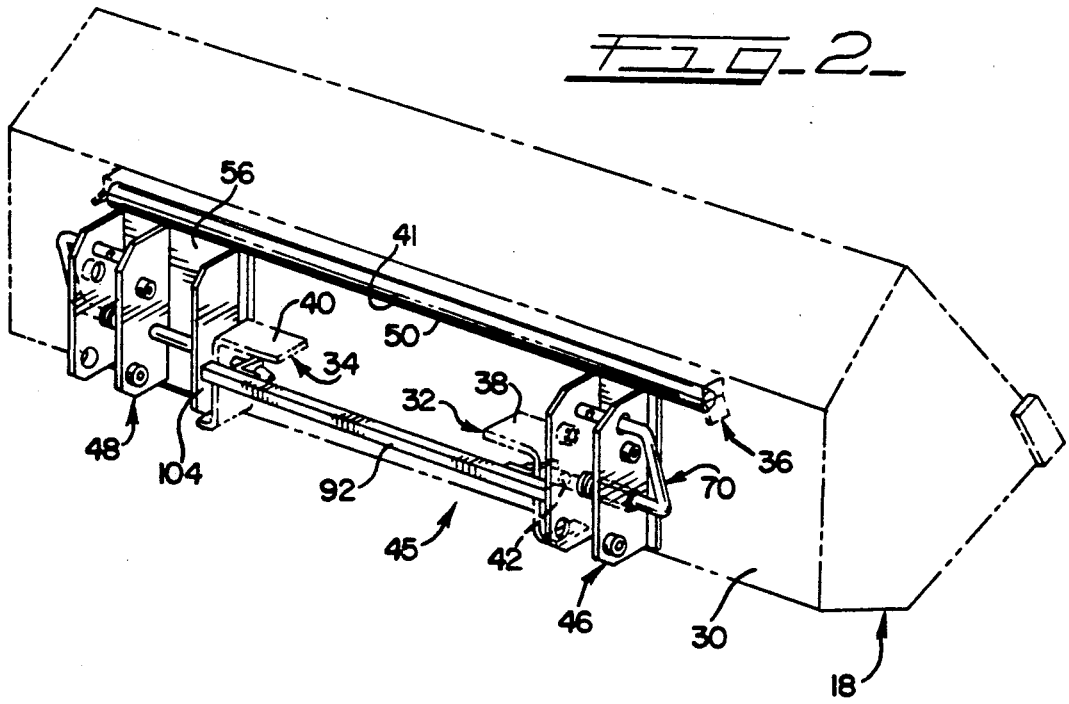
FIG. 2 is a perspective view of the quick attaching mechanism of the present invention with its relationship with an implement being shown in phantom and with different lateral spacings being schematically illustrated between a centerline of a boom assembly and automatically operated assemblies arranged at opposite ends of the attaching mechanism.
Figures 3, 7:
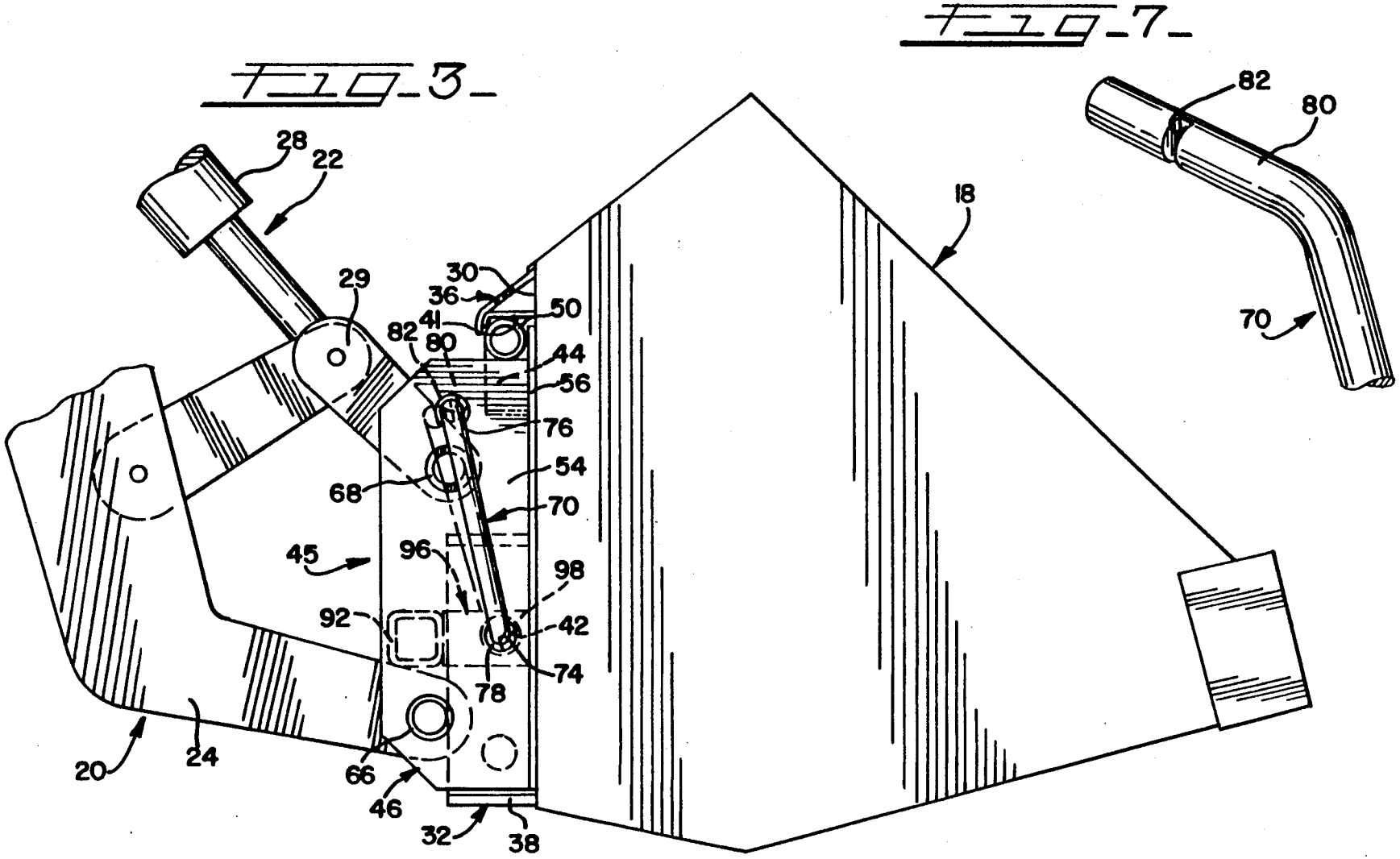
FIG. 3 is a side elevational view illustrating the quick attaching mechanism being connected to an implement and to implement tilting and implement lifting mechanisms of the front-end loader.
FIG. 7 is a fragmentary perspective view of a fastening pin forming part of the quick attaching mechanism.
Figure 4:
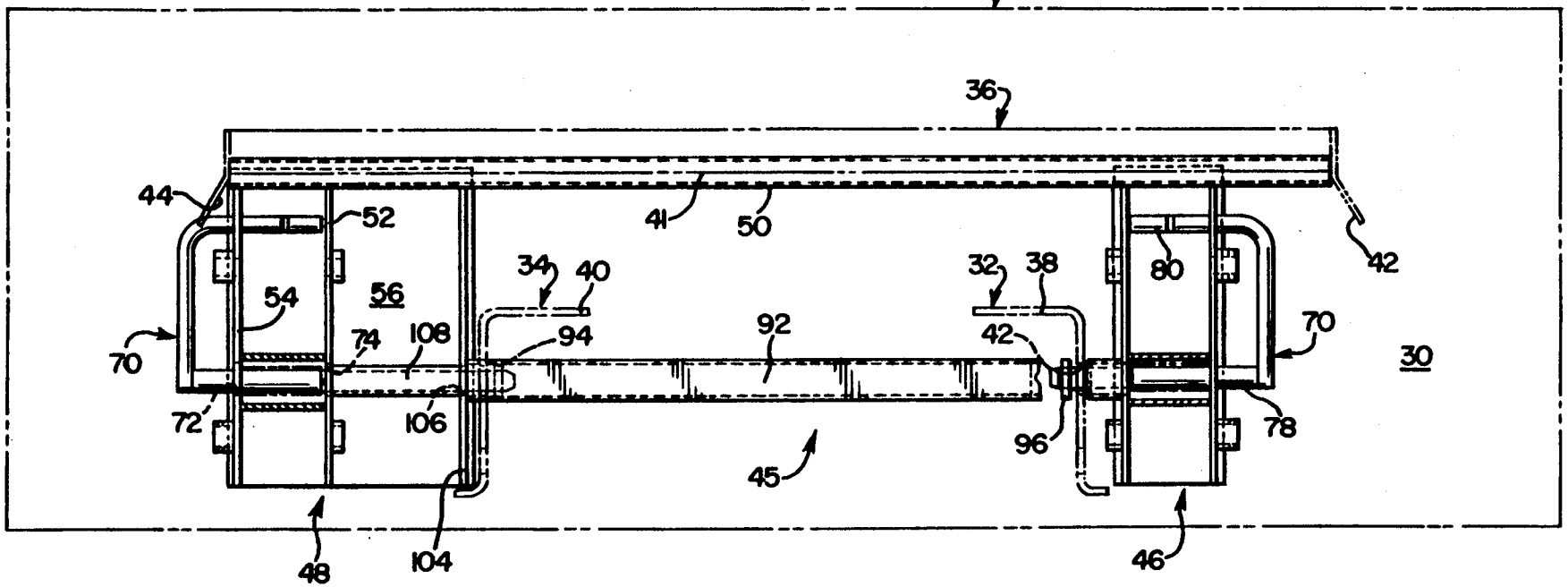
FIG. 4 is a rear elevational view of the quick attaching mechanism of the present invention with certain areas broken away for clarity and showing the relationship between the attaching mechanism and implement in phantom and with different lateral spacings being schematically illustrated between a centerline of a boom assembly and automatically operated assemblies arranged at opposite ends of the attaching mechanism.

As illustrated in FIGS. 2, 3 and 4, a rear vertical surface 30 of the implement 18 is provided with a pair of female coupling structures 32 and 34 and an elongated horizontal mounting member 36. The female coupling structures are comprised of steel mounting flanges 38 and 40, respectively, which are preferably welded in laterally aligned and spaced relation relative to each other on the rear surface 30 of the implement 18. As illustrated, the elongated horizontal mounting member 36 is secured toward and centered along an upper edge of the rear surface 30 of the implement 18. The horizontal mounting member 36 defines a downwardly opening channel 41 on the rear surface 30 of the implement. For purposes to be described in detail hereinafter, opposite ends of the horizontal mounting member 36 are provided with camming surfaces 42 and 44 which incline upwardly and inwardly toward channel 41. The elongated design of mounting member 36 facilitates use of the same implement on front-end loaders with boom assemblies having varying lateral widths between the lift arms thereof.

In the illustrated embodiment, the mounting flanges 38 and 40 are spaced apart a predetermined distance which is less than a distance separating the lift arms 24 of the boom or loader arm structure. Essentially, as shown, the mounting flanges 38 and 40 are mirror images of each other. Hence, a description of mounting flange 38 will suffice, there being no need for what would be essentially a duplicative description of the mounting flange 40. Suffice it to say, each mounting flange rigidly and rearwardly extends from the rear vertical surface 30 of the implement 18 and defines an aperture 42 which passes therethrough.

A quick attaching mechanism 45 is attached to the forward end of the boom assembly 16 to enable the implement 18 to be selectively coupled and uncoupled from the front-end loader 10. Broadly, the quick attaching mechanism 45 includes a pair of male coupling structures 46 and 48 which are rigidly joined or connected to each other by an elongated member 50. Each male coupling structure 46 and 48 defines an automatically operated attaching assembly and each is independently connected to the implement lifting mechanism 20 and the implement tilting mechanism 22. The male coupling structures 46 and 48 are adapted to be selectively fastened to the female coupling structures 32 and 34 in a manner releasably fastening the implement 18 to the boom assembly 16 of the material handling apparatus 10.

As illustrated in FIG. 4, each male coupling structure 46, 48 depends from and is connected intermediate the opposite ends of the elongated member 50. Essentially, as shown, the male coupling structures are mirror images of each other. Hence, a detailed description of the male coupling structure 46 will suffice, there being no need for what would be essentially duplicative descriptions of the male coupling structure 48.

Figure 6:
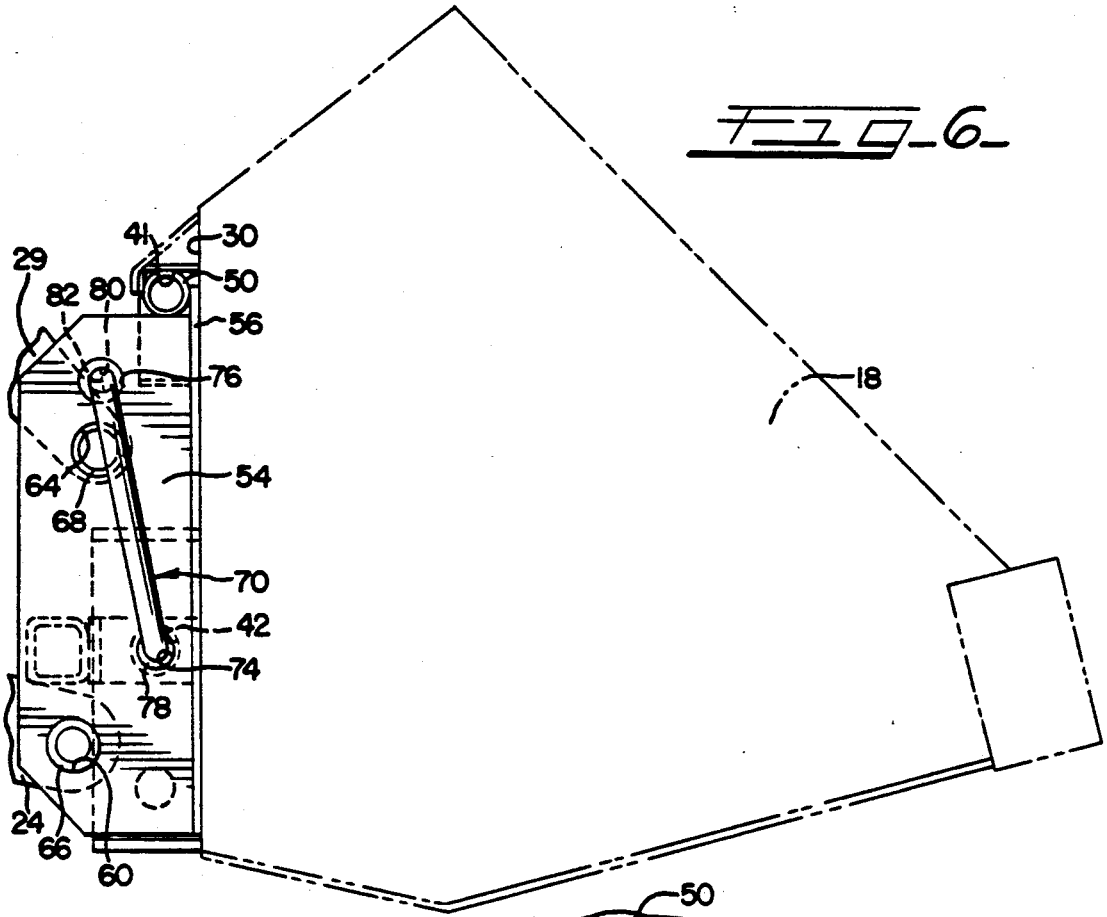
FIG. 6 is an enlarged side elevational view of the quick attaching mechanism of the present invention with its relationship with an implement being shown in phantom.
Figure 5:
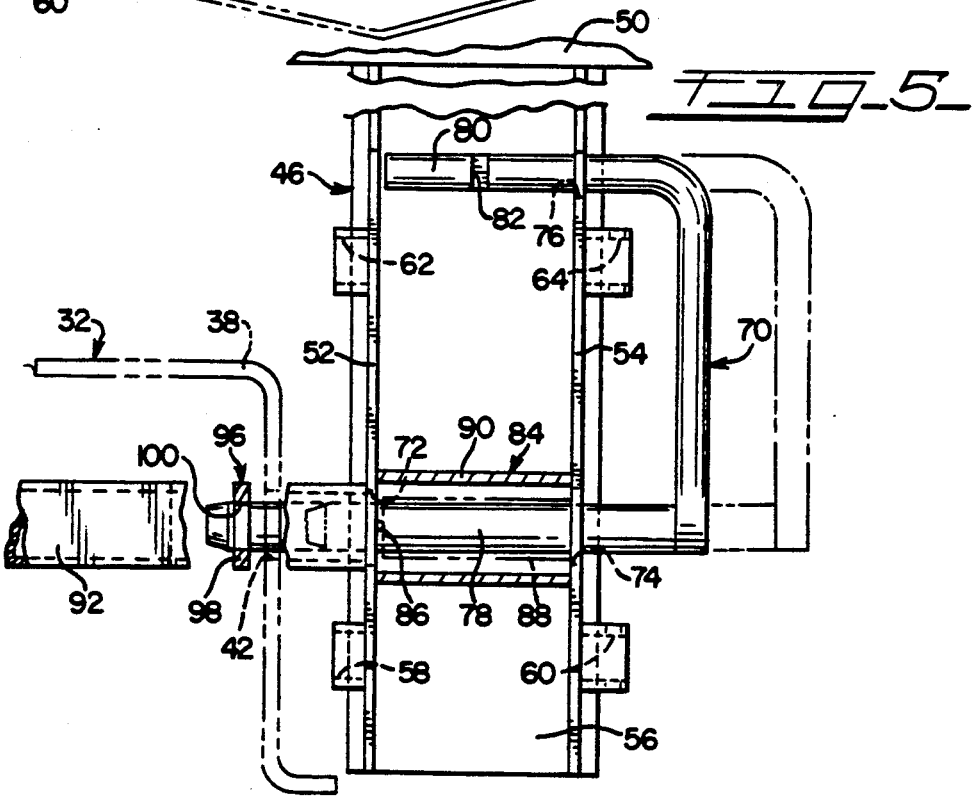
FIG. 5 is an enlarged rear elevational view of an automatically operated assembly forming part of the present invention.

Turning to FIG. 5, each male coupling structure includes inner and outer rigid and upright or vertical frame members 52 and 54 which define a confining opening therebetween and are joined by a backplate member 56. Each of the members 52, 54 and 56 is welded or otherwise rigidly connected at their upper ends to the elongated member 50. The frame members 52 and 54 define a first pair of laterally aligned apertures 58 and 60, respectively, and a second pair of laterally aligned apertures 62 and 64, respectively. The first and second pair of apertures being arranged in upper and lower positions relative to each other on the frame members 52 and 54. As illustrated in FIG. 6, remote ends of the respective lift arms 24 and remote ends of the respective linkage assemblies 29 are connected within the confining opening defined between members 52 and 54 as with pins 66 and 68, respectively, which laterally extend through the first and second pairs of apertures 58, 60 and 62, 64, respectively.

The elongated member 50 is substantially the same length as the horizontal mounting member 36 on the implement 18. The elongated length of member 50 provides a wide latitude in the possible lateral spacing to be provided between the male coupling structures 46 and 48. Preferably, the elongated member 50 is configured as a rigid cylindrical tube.

Each male coupling structure is further provided with an automatically operated fastening pin 70 movable along a generally linear path of travel between engaged and disengaged positions. As illustrated in FIG. 5, the inner and outer frame members 52 and 54 define another pair of laterally aligned apertures 72 and 74. In the illustrated embodiment, the outer frame member 54 of each male coupling structure further defines an aperture 76 located above apertures 72 and 74.

The fastening pin 70 is provided with an elongated leg portion 78 which passes through the apertures 72 and 74. The leg portion 78 of fastening pin 70 is of sufficient length such that, when pin 70 is in an engaged position, a free end of leg portion 78 extends from a laterally outward side of a respective male coupling structure through the upright frame members thereof and through the aperture 42 in an adjacent female coupling structure in a manner releasably fastening the implement 18 to the quick attaching mechanism 45 of the present invention and thereby to the loader 10.

In a preferred embodiment, the fastening pin 70 has a generally J-shape configuration. A second leg portion 80 of the J-shape fastening pin passes from a laterally outward side of a respective male coupling structure and through the aperture 76 defined by the outer frame member 54 of the male coupling structure. To hold the fastening pin in a disengaged position, and as illustrated in FIGURE 7, the leg portion 80 of the J-shape pin is provided with a suitable detent or notch 82 along its length. The detent 82 is sufficiently wide such that it may receive a portion of the outer frame member 54 between opposite sides thereof.

To facilitate an automatic fastening operation between the male and female coupling structures, a suitable spring mechanism 84 is entrapped between the inner and outer upright frame members 52 of each male coupling structure. The spring mechanism 84 is provided to yieldably urge and automatically move the fastening pin 70 from a disengaged position toward a fastening relation with an adjacent female coupling structure.

In the illustrated embodiment, the spring mechanism 84 includes a cross-pin 86 which extends through the elongated leg portion 78 of the fastening pin 70. A suitable compression spring 88 is entrapped between the cross-pin 86 and the outer frame member 54 of a respective male coupling structure such that one end of the spring impinges upon the cross-pin 86 and the opposite end of the spring impinges against the inner wall of outer frame member 54 of the male coupling structure. The cross-pin 86 is longer than the width of aperture 72 through which the elongated leg portion 78 of fastening pin 70 extends. Accordingly, cross-pin 86 limits linear movement of the fastening pin 70 from its disengaged position when the pin 86 contacts the inner surface of inner frame member 52. To avoid working environment contaminants from interfering with automatic operation of the fastening pin 70 under the influence of spring 88, a cover or sleeve 90 is preferably provided along substantially the entire length of the spring 88.

To add rigidity to the quick attaching mechanism of the present invention, the male coupling structures 46 and 48 are further rigidly joined to each other by a lateral stabilizer bar 92. As illustrated in FIG. 4, the lateral stabilizer bar 92 is provided with a pair of laterally spaced and apertured members 94 and 96 which are arranged laterally inward from the female coupling structures 32 and 34. As illustrated in FIG. 5, each member 94, 96 includes a flange 98 which extends away from stabilizer bar 92 toward the rear surface 30 on the implement. Flange 98 of each member 94, 96 defines an aperture 100. As will be understood, when the respective male and female coupling structures are moved into full interlocking engagement, aperture 100 is aligned with the path of travel of the elongated leg portion 78 of fastening pin 70.

A salient aspect of the present invention is that the lateral distance separating the female coupling structures 32, 34 does not have to correspond or align with the lateral distance separating the lift arms on the material handling apparatus to which the implement is to be attached. Therefore, a material handling apparatus having wide lateral spacing between the loader lift arms may nevertheless be fastened to an implement having female coupling structures which are separated by a different lateral distance therebetween.

Depending on the lateral spacing between the lift arms 24 of the boom assembly 16 and the female coupling structures on the implement, it may be beneficial to provide the male coupling structures with an additional upright frame member 104. In FIG. 4, the coupling structure 48 has been modified to work with boom assemblies having a wide lateral spacing (about 55 inches) between its lift arms. As illustrated, in a modified male coupling structure, the additional frame member 104 can be interconnected to the adjacent frame members of the respective male coupling structure by a lateral extension of the backplate 56. To facilitate movement of the free end of the fastening pin 70 therethrough, the frame member 104 is provided with an aperture 106 which is laterally aligned with the apertures 72 and 74 in the adjacent mounting members 52 and 54 of the respective male coupling structure. Moreover, and because of the extended lateral space between the male and female coupling structures, an elongated guide tube 108 may be provided between upright members 104 and 52 to facilitate guiding of the free end of the fastening pin 70 into fastening relation with the adjacent female coupling structure.

In preparing to attach the implement 18 to the loader or boom assembly 16, the fastening pin 70 of each male coupling structure is manually pulled outwardly against the action of the spring mechanism 84 into a disengaged position illustrated in phantom lines in FIG. 5. After moving the fastening pin 70 to its disengaged or unfastened position, the fastening pin 70 is rotated about the elongated axis of the leg portion 78 such that the locking notch or detent 82 defined by the second leg portion 80 of pin fastening 70 is moved into locked association with the outer frame member 54 of the respective male coupling structure. The action of the spring mechanism 84 against the fastening pin 70 provides sufficient force to maintain the fastening pin 70 in a releasably fastened relation with the outer frame member 54.

Notably, the locking notch or detent 82 is located on the leg portion 80 such that when the fastening pin 70 is releasably retained in its disengaged position, the free end of the elongated leg portion 78 of the fastening pin 70 is sufficiently retracted as to be laterally moved out of the fore-and-aft path of the adjacent female coupling structure on the implement to be attached to the boom assembly. When the fastening pin 70 is moved into a disengaged position, a segment of the upper leg 80 of the fastening pin 70 laterally extends above and across a portion of the implement linkage mechanism 29 of the tilt mechanism attached to each coupling structure.

To automatically and releasably fasten the implement 18 to the boom assembly 16, the operator initially guides the elongated member 50 on the quick attaching mechanism into a seated relationship in the downwardly opening channel 41 of the mounting member 36 as by means of operating the implement lift mechanism 20 and implement tilting mechanism 22. By designing the elongated member 50 to be substantially equivalent in length to the channel 41, opposite ends of the elongated member 50 cooperate with the bevelled surfaces 42 and 44 on the mounting member 36 to facilitate alignment of the elongated member 50 within the channel 41 of the mounting member 36 and thereby alignment of the implement 18 to be attached to the boom assembly 16.

Raising the lift arms 24 causes the implement 18 to hang on the elongated member 50 seated in the channel 36 of the mounting member 34 and raises the implement 18 from the ground or its rest position. As the implement 18 is raised and the elongated member 50 moves more snugly into the channel 36 of the mounting member 34, the implement 18 tends to swing or rotate about the elongated member 50 such that the rear vertical face 30 of the implement tends to swing rearwardly toward the backplate members 56 of the male coupling structures, thus positioning the apertures 42 in the female coupling structures for engagement with the fastening pins 70 of each male coupling structure.

To complete automatic fastening of the implement 18 to the boom assembly 16, the implement tilting mechanism 22 is retracted. Retraction of the implement tilting mechanism 22 causes the linkage mechanism 29 to initiate a fastening action between the fastening pin 70 of each male coupling structure and each female coupling structure. In the illustrated embodiment, a portion of the linkage mechanism 29 of each implement tilting mechanism 22 imparts a camming action to the segment of the second leg portion 80, passing across and above the implement tilting mechanism between the inner and outer plate members of each male coupling structure. Such camming action ultimately releases the locking notch 82 in the fastening pin 70 from its locking association with the outer frame member of the male coupling structure thereby permitting the associated spring 88 to forcibly and automatically move the elongated leg portion 78 of fastening pin 70 of each male coupling structure through the aperture 42 in the adjacent female coupling structure upon alignment therewith and to releasably lock the implement 18 to the loader boom assembly 16.

By extending over substantially the entire length of the spring, the sleeve 90 inhibits contaminants in the working environment from clogging or wedging between spring segments and thereby maintains the spring mechanism 84 in operative order regardless of the working environment in which the loader may be utilized.

The stabilizer arm 92 extending between the male coupling structures 46 and 48 of the quick attaching mechanism of the present invention adds rigidity to the quick attaching mechanism. When the implement swings backward into contact with the backplate members 56 of the male coupling structures, the apertured members 94 and 96 on the stabilizer arm 92 are positioned to accommodate the free end of the fastening pin 70.

In its engaged position, the fastening pin 70 of each male coupling structure passes from one side of the female coupling structure, through the aperture 42 in a mounting flange of the female coupling structure, and also through the aperture 100 in the respective aperture member on the stabilizer bar 92. Accordingly, the fastening pin 70, when in its engaged position, is in double shear after the implement 18 is releasably connected to the boom assembly 16.

In the illustrated embodiment, the distance separating the male coupling structures of the quick attaching mechanism is greater than the distance separating the female coupling structures attached to the implement 18. The elongated leg portion 78 on the fastening pin 70 of each male coupling structure bridges the lateral spacing therebetween in a manner accommodating different size lateral spacings between the lift arms and the female coupling structures on the implement, while maintaining automatic operation of the quick release mechanism.

In those embodiments wherein the lift arms 24 of the boom assembly 16 are spaced apart a greater distance than may be bridged by a particular fastening pin, a like fastening pin having an elongated leg portion which is different from that currently being used is interchanged with the fastening pin so as to bridge the space between the male coupling structure and the female coupling structure. In those instances where there is a substantial distance separating the lift arms 24 on the boom assembly from mounting flanges of the female coupling structure on the implement 18, the male coupling structures may be further modified with an additional frame member 104. A tubular bushing or bearing 108 may also be added for guiding the elongated leg portion 78 of the fastening pin 70 therealong and into a fastening relation with the adjacent female coupling structure.

With a quick attaching mechanism according to the present invention, the lateral spacing between the lift arms 24 of the boom assembly 16 is not necessarily restricted to the particular spacing between the female coupling structures 46 and 48 secured on the implement. The ability to use interchangeable fastening pins for bridging the lateral spacings therebetween greatly enhances the versatility of the front-end loader in an economical and quickly replaceable manner.

From the foregoing, it will be observed that numerous modifications and variations can be effected without departing from the true spirit and scope of the novel concept of the present invention. It will be appreciated that the present disclosure is intended to set forth an exemplification of the invention which is not intended to limit the invention to the specific embodiments illustrated. The disclosure is intended to cover by the appended claims all such modifications as fall within the scope of the claims.

What is claimed is:

1. A quick attaching mechanism for automatically fastening an implement to a material handling apparatus having a loader arm structure with implement lift means including a pair of laterally spaced lift arms and implement tilting means, said implement being provided with a pair of laterally spaced female coupling structures and a horizontal mounting member defining a downwardly opening channel on a rear surface of said implement, with said female coupling structures being spaced apart a lateral distance different than a lateral distance separating said lift arms, said quick attaching mechanism comprising:

a pair of male coupling structures adapted to be operatively connected to said implement lift means and said implement tilting means, each male coupling structure being connected to a respective lift arm of the loader arm structure, and a horizontally elongated member adapted to be seated in said channel of said mounting member on said implement and which joins the male coupling structures to each other such that each male coupling structure is arranged in a laterally spaced relationship to one side of a respective female coupling structure to accommodate for variations in lateral distances between the lift arms and the female coupling structures, with each male coupling structure further including a fastening pin provided with an elongated leg portion of sufficient length to bridge the lateral distance between an associated male coupling structure and a respective female coupling structure, said pin engaging with a portion of said loader arm structure when said implement is to be attached thereto, and means for resiliently biasing the fastening pin toward an adjacent female coupling structure, the engagement of said pin by said loader arm structure causing said resilient biasing means to forcibly move said pin into a fastening relation with said adjacent female coupling structure adjacent thereto thereby releasably fastening the implement to the loader arm structure.

2. A quick attaching mechanism for automatically fastening an implement to a material handling apparatus having a loader arm structure with implement means including a pair of laterally spaced lift arms and implement tilting means, said implement being provided with a pair of laterally spaced female coupling structures and a horizontal mounting member defining a downwardly opening channel on a rear surface of said implement, with said female coupling structures being spaced apart a distance different than a distance separating said lift arms, said quick attaching mechanism comprising:

a pair of laterally spaced male coupling structures adapted to be operatively connected to said implement lift means and said implement tilting means and to be automatically fastened to said female coupling structures in a manner releasably fastening the implement to the loader arm structure, each male coupling structure including inner and outer upright members, each male coupling structure having a remote end of one of said lift arms and a remote end of said implement tilting means connected between said inner and outer upright members, an elongated member joining the male coupling structures in laterally spaced relation to each other and which is adapted to be seated in said channel of said mounting member on said implement, each male coupling structure further including a fastening pin provided with an elongated leg portion and means for resiliently biasing the fastening pin, wherein said inner and outer upright member defining laterally aligned apertures which slidably guide said elongated leg portion of said fastening pin for resiliently biased movement toward and into a fastening relation with a respective female coupling structure arranged adjacent thereto, said fastening pin further including a second leg portion, said outer upright member of each male coupling structure defining an aperture through which at least a portion of said second leg portion of said pin passes for initiating a fastening action between a male coupling structure and an adjacent female coupling structure on said implement through interaction of said second portion of said pin with said implement tilting means and thereby releasably fastening the implement to the lift arm structure.

3. The quick attaching mechanism according to claim 2 wherein said means for resiliently biasing includes spring means entrapped between said inner and outer upright members for resiliently biasing and moving said fastening pin toward a fastening relation with a respective female coupling structure.

4. A quick attaching mechanism for releasably fastening an implement provided with a laterally extending mounting member and two laterally spaced and apertured mounting flanges to a material handling apparatus having a loader arm structure including implement lifting means with a pair of laterally spaced lift arms and implement tilting means, said quick attaching mechanism comprising:

two attaching assemblies which are connected to said implement lifting means and said implement tilting means, an elongated member joining the two attaching assemblies and which is adapted to be rotationally seated under said mounting member, said attaching assemblies being laterally spaced-apart by a dimension greater than the maximum dimension separating the laterally spaced mounting flanges on said implement such that each attaching assembly is arranged laterally outwardly from a respective mounting flange; and each attaching assembly comprising first means for attaching said implement lifting means thereto and second means for attaching said implement tilting means thereto in upper and lower positions relative to each other, and means for releasably and automatically fastening the attaching assembly fastening said loader are structure to said implement, said fastening means including a J-shape fastening pin and a spring for resiliently biasing said pin, said pin being movable between engaged and disengaged positions relative to a respective mounting flange, said fastening pin having a laterally elongated leg portion of sufficient length to laterally extend across the distance separating a respective attaching assembly from an adjacent mounting flange and accommodating for variations in lateral spacings therebetween, a portion of said pin interfering with a path of movement taken by and engaging with said tilting means when said implement is attached to said loader arm structure, the engagement of said pin by said tilting means causing said pin to automatically move toward an engaged position under the influence of said spring and into a releasable fastening relation with an adjacent apertured mounting flange on said implement thereby automatically and releasably fastening the implement to the loader arm structure.

5. The quick attaching mechanism according to claim 4 further including a lateral stabilizer interconnecting said two attaching assemblies to add rigidity to the attaching mechanism.

6. The quick attaching mechanism according to claim 5 wherein said lateral stabilizer includes a pair of laterally spaced apertured members arranged thereon, each apertured member being arranged on an opposite side of one of said mounting flanges when said implement is positioned for attachment to said loader arm structure, said apertured members being arranged to receive a free end of the elongated leg portion of said fastening pin thereby placing said fastening pin in double shear after it passes through said mounting flange on said implement.

7. A quick attaching mechanism for releasably fastening an implement provided with a laterally extending mounting member and two laterally spaced and apertured mounting flanges to a material handling apparatus having a loader arm structure including implement lifting means with a pair of laterally spaced lift arms and implement tilting means, said quick attaching mechanism comprising:

two attaching assemblies which are connected to said implement lifting means and said implement tilting means, an elongated member joining the two attaching assemblies and which is adapted to be rotationally seated under said mounting member, said attaching assemblies being laterally spaced-apart by a dimension greater than the maximum dimension separating the laterally spaced mounting members on said implement; and with each attaching assembly including inner and outer upright members secured to and depending from said elongated member in laterally spaced relation from one of said mounting flanges on said implement, each attaching assembly further including first means for attaching said implement lifting means thereto and second means for attaching said implement tilting means thereto in upper and lower positions relative to each other, and with each attaching assembly further comprising means for automatically and releasably fastening the implement thereto and thereby to the loader arm structure, said fastening means including a J-shaped fastening pin yieldably urged toward a releasable fastening relation with an adjacent mounting flange on said implement and having a laterally elongated leg portion, said inner and outer upright members of each attaching assembly defining laterally aligned apertures through which the elongated leg portion of said J-shape fastening pin slidably passes, said fastening pin further including a second leg portion, the outer upright member of each attaching assembly defining an aperture through which said second leg portion of said J-shape fastening pin slidably passes, a segment of said second leg portion of said J-shape fastening pin passing in relation to said tilting means such that a fastening action between each attaching assembly and a respective apertured flange on said implement is initiated when the implement tilting means is actuated.

8. The quick attaching mechanism according to claim 7 wherein each attaching assembly further includes spring mechanism for yieldably urging and moving said fastening pin towards a fastening relation with said apertured flange on the implement, said spring mechanism includes a spring, a first end of which acts against said fastening pin and a second end of which acts against said attaching assembly.

9. The quick attaching mechanism according to claim 8 wherein said second leg portion on said J-shape fastening pin is provided with a notch for allowing said fastening pin to be releasably secured in position to said attaching assembly and such that the spring which urges and moves the fastening pin toward a fastening position is compressed when said fastening pin is moved to a disengaged position.

10. A quick attaching mechanism adapted to be releasably fastened to an implement, said quick attaching mechanism comprising:

a pair of male coupling structures, a horizontally elongated member extending over and rigidly joining the male coupling structures in laterally spaced relation to each other, and a stabilizer bar extending beneath said elongated member for joining the male coupling structures to each other and thereby adding rigidly to the quick attaching mechanism, each male coupling structure including inner and outer upright members defining laterally aligned apertures, a fastening pin having a generally J-shaped configuration with an elongated leg portion extending lengthwise through said laterally aligned apertures and through opposite sides of a respective male coupling structure for movement between engaged and disengaged positions, said outer upright member of each male coupling structure defining an aperture through which another leg portion of said J-shape fastening pin slidably passes, means for releasably holding the fastening pin in a disengaged position, and spring means for acting against the elongated leg portion of the fastening pin in a manner yieldably urging the fastening pin toward its engaged position whereby upon release of said pin from its disengaged position a free end of the elongated leg portion automatically passes into a fastening relation with an adjacent female coupling structure on the implement to be releasably fastened thereto.

11. The quick attaching mechanism according to claim 100 wherein said stabilizer bar includes a pair of apertured members extending away from and disposed along the length of said stabilizer bar, each apertured member slidably receiving the free end of the elongated leg portion of the fastening pins, thereby placing said elongated leg portion in double shear after passing into a fastening relation with the adjacent female coupling structure.

12. A quick attaching mechanism adapted to be releasably fastened to an implement, said quick attaching mechanism comprising:

a pair of male coupling structures, each male coupling structure including inner and outer upright members, a horizontally elongated member extending over and rigidly joining the male coupling structures in laterally spaced relation to each other, and a stabilizer bar extending beneath said elongated member for joining the male coupling structures to each other and thereby adding rigidity to the quick attaching mechanism, each male coupling structure further including a fastening pin having an elongated leg portion, said inner and portion upright members of each male coupling structure further defining laterally aligned apertures through which said elongated leg portion has been inserted therefor, slidably moves between engaged and disengaged positions detent means provided on said fastening pin for releasably holding the fastening pin in a disengaged position by engaging a portion of the outer upright member of a respective male coupling structure, and spring means for acting against the elongated leg portion of the fastening pin in a manner yieldably urging the fastening pin toward its engaged position, whereby upon release of said fastening pin from its disengaged position by releasing said detent means from engagement with said portion of said outer upright member, a free end of the elongated leg portion passes into a fastening relation with an adjacent female coupling structure on the implement to be releasably fastened thereto.

13. A quick attaching mechanism mounted on a forward end of a boom assembly of a front-end loader, said boom assembly including two sets of lifting and tilting means disposed on opposite sides of said boom assembly, said quick attaching mechanism comprising:

a first male coupling structure connected to a first set of lifting and tilting means, a second male coupling structure connected to a second set of lifting and tilting means, a horizontally elongated member extending over and rigidly joining the first and second male coupling structures in laterally spaced relation to each other, each male coupling structure including a fastening pin having an elongated leg portion of sufficient length such that a free end of said elongated leg portion passes lengthwise from an outer side of said male coupling structure through and for a lengthwise distance past an inner side of said male coupling structure and is movable between engaged and disengaged positions, means for releasably holding the fastening pin in a disengaged position, said fastening pin having a second leg portion extending above and across a path of movement taken by said tilting means, each male coupling structure further including spring means acting against and forcibly moving the fastening pin toward its engaged position upon release of said holding means in response to engagement of said second leg portion of said pin by said tilting means.

14. The quick attaching mechanism according to claim 13 wherein each male coupling structure includes inner and outer upright members defining a confining opening therebetween and wherein remote ends of a set of lifting and tilting means are articulately connected in lower and upper relation to each other and wherein said inner and outer upright members define laterally aligned apertures through which the elongated leg portion of said fastening pin slidably passes.

15. A quick attaching mechanism mounted on a forward end of a boom assembly of a front-end loader, said boom assembly including two sets of lifting and tilting means disposed on opposite sides of said boom assembly, said quick attaching mechanism comprising:

a first male coupling structure connected to a first set of lifting and tilting means, a second male coupling structure connected to a second set of lifting and tilting means, a horizontally elongated member extending over and rigidly joining the first and second male coupling structures in laterally spaced relation to each other, each male coupling structure including inner and outer upright members defining a confining opening therebetween and wherein remote ends of a set of lifting and tilting means are articulately connected in lower and upper relation to each other, each male coupling structure further including a fastening pin having a generally J-shape configuration with an elongated leg portion and a second leg portion, said male coupling structures including laterally aligned apertures through which the elongated leg portion passes for movement between engaged and disengaged positions the outer upright member of each male coupling structure defining an aperture allowing at least a segment of said second leg portion of said fastening pin to slidably pass into the confining opening defined between the upright members, with the segment of said second leg portion passing into said confining opening extending across and above a remote end of the tilting means, and means for releasably holding the fastening pin in said disengaged position, each male coupling structure further including spring means acting against the elongated leg portion of the fastening pin for allowing said fastening pin to be moved into a disengaged position and forcibly moving the fastening pin toward an engaged position upon release of said holding means by said tilting means being actuated.

16. The quick attaching mechanism according to claim 15 further including a stabilizer bar extending beneath said horizontally elongated member for joining the male coupling structures to each other thereby adding rigidity to the quick attaching mechanism.

* * * * *